US005820719A

United States Patent [19]

Strickland et al.

[11] Patent Number: 5,820,719

[45] Date of Patent: Oct. 13, 1998

[54] METHOD FOR FORMING A SOLE HAVING A HEAT ACTIVATABLE ADHESIVE ADHERED TO ONE SIDE THEREOF FOR SUBSEQUENT ATTACHMENT TO AN UPPER

[75] Inventors: Barbara A. Strickland, Hudson; James H. Kerouack, Bedford, both of N.H.; Vitale Brinzow, Richmond, Me.

[73] Assignee: Worthen Industries, Inc., Nashua, N.H.

[21] Appl. No.: 790,242

[22] Filed: Jan. 28, 1997

[51] Int. Cl.[6] ..... A43B 13/12; A43B 13/32; B32B 31/04

[52] U.S. Cl. ..... 156/245; 36/19.5; 156/289; 156/308.2; 264/135; 264/259

[58] Field of Search ..... 156/245, 289, 156/308.2; 264/135, 244, 259, 266, 328.1; 12/142 R, 146 B, 146 BR; 36/12, 14, 19.5, DIG. 1, 32 R, 30 R

[56] References Cited

U.S. PATENT DOCUMENTS

| | | | |
|---|---|---|---|
| 1,917,737 | 7/1933 | Schacht | 12/146 BR |
| 3,693,269 | 9/1972 | Guarrera | 36/19.5 |
| 4,973,371 | 11/1990 | Parker | 156/245 |

FOREIGN PATENT DOCUMENTS 2187998 9/1987 United Kingdom .

*Primary Examiner*—Richard Crispino
*Attorney, Agent, or Firm*—Samuels, Gauthier, Stevens & Reppert

[57] ABSTRACT

A sole assembly is made by placing a release film, having a heat activatable adhesive on one side, in a mold and forming a sole in the mold. The adhesive forms an integral part of the completed sole which allows handling of the molded sole without displacing the adhesive or the release film. The molded sole is used by removing the release film, activating the adhesive and bonding the sole to an upper.

3 Claims, 1 Drawing Sheet

METHOD FOR FORMING A SOLE HAVING A HEAT ACTIVATABLE ADHESIVE ADHERED TO ONE SIDE THEREOF FOR SUBSEQUENT ATTACHMENT TO AN UPPER

FIELD OF THE INVENTION

Sole Assemblies for footwear.

BACKGROUND OF THE INVENTION

In the manufacture of footwear, several steps in the process require that surfaces be bound together by adhesives. Once the surfaces are adhered they may or may not be stitched depending upon the specific footwear construction. Typically, solvent-based adhesives are used for the adhesive applications. The surfaces that are adhered together are often conditioned such as by washing, roughening, etc. in order to ensure a good adhesive bond.

A component in footwear construction is the sole of the footwear. For certain types of footwear the soles are molded and after molding they are adhesively secured to an upper. The unit soles are usually injection molded from thermoplastic materials, e.g. urethanes, polyvinyl chlorides, block copolymers (Kraton®), polyolefins, etcetera. Prior to the molding step, a mold release is applied to the surfaces of the mold which will contact the sole during the molding step. The agent transfers, at least in part, to the surface of the molded sole.

Typically the next step in the manufacturing process is the attachment of the sole to the upper. The surface of the molded sole where the adhesives will be applied are cleaned to remove the mold release agent and may be abraded for enhanced bonding. This step is critical in that any mold release agent left on the adhesive margin of the sole will contaminate the bond line and result in failure of the adhesive. Adhesive application machines apply a ribbon of adhesive to the periphery of the sole. The cemented surface of the upper is then put into contacting engagement with the adhesive on the sole and pressure applied to insure a good adhesive bond.

The present invention embodies a sole assembly comprising an outer sole, a film of heat activatable adhesive molded into (absorbed) the sole and on the surface (adsorbed) of the sole and a release film over the adhesive. The sole per se is formed by prior art techniques.

The adhesive is an integral part of the sole. This allows the handling of the molded sole assemblies without displacing either the adhesive film or liner prior to the bonding step.

When the molded sole is used in the next step of the bonding process the release liner is simply removed, the adhesive on the sole is activated, and the upper attached. No washing or further sole preparation is necessary.

The adhesive properties are the same or better than prior art adhesives. The chemical nature of the adhesive is not critical. For the adhesive, the various adhesives are selected such that they possess at least the following characteristic - - - an adhesive which has an affinity for the surface which is greater than the cohesive force of the adhesive layer such that the adhesive bond will not break but rather the substrate will tear.

Further, for the adhesive to be suitable for its use in bonding the outer sole to the upper in addition to causing substrate tearing bonds when forcefully pulled apart, it preferably must meet or exceed the following performance tests:

1. Reactivate at 115°–125° F.
2. Have enough initial tack or grab to adhere the sole to the upper without slipping, prior to fully pressing.
3. Bond to the upper permanently within 8 seconds under pressure.
4. Pass standard heat and water resistance tests (140° F./95% R.H., and 48 hour water soak).
5. Be impervious to oil and plasticizer migration; and
6. Pass 100,000 flex cycles without opening.

Film adhesives generally useful in the practice of the invention would include compounded thermoplastic resins, such as polyurethanes, polyolefins, or ethylene vinyl acetates. Obviously, the adhesive of choice is based upon the composition of the sole to which the upper is to be attached and the composition of the upper.

The release liner used, such as silicone, polyethylene coated paper, polyethylene or polypropylene, can be used for the applications described herein, as long as the release liner provides a weak bond to the face of the adhesive and should be as thin as possible while still serving that function.

The following sole/adhesive/upper combinations are believed suitable for purposes of the invention: polyurethane, polyvinyl chloride, or block copolymer for the soles/polyurethanes for the adhesives polyurethane film/leather, fabric, or synthetic (PVC, urethane, etc.) for the uppers; polyethylene, polypropylene, or EPDM blends for the soles/polyolefins for the adhesives/polyolefin film/leather or fabric, for the uppers; and EVA (ethylene vinyl acetate) for the soles/ethylene vinyl acetates or chlorinated rubber compounds for the adhesives/EVA film/leather, fabric, or non-PVC synthetic for the uppers.

DESCRIPTION OF THE PREFERRED EMBODIMENT(S)

Figure 1:
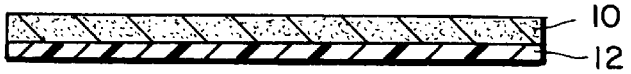
FIG. 1 is an illustration of an adhesive film cast on a release liner.

FIG. 1 is an illustration of an adhesive film 10 cast on release paper 12. The adhesive film 10, as will be described, completely covers and becomes an integral part of the top layer of the molded sole.

Figure 2:
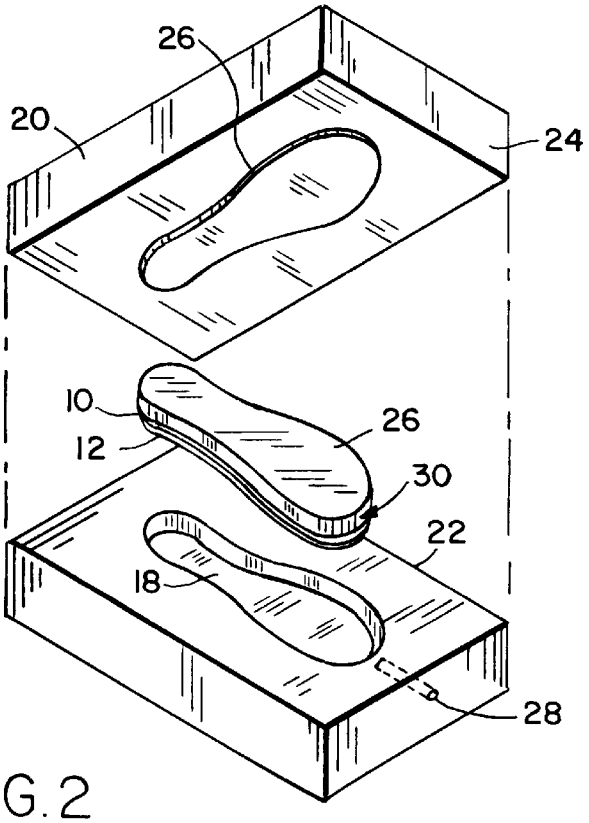
FIG. 2 is a perspective view of a sole assembly and an injection mold.

As shown more clearly in FIG. 2, the adhesive film 10 covers the entire top of a molded sole 26. The adhesive is supplied in film form, typically 3–7 mils thick, either cast from solvent or extruded directly onto a release carrier. These coatings techniques per se are well known in the art.

Figure 3:
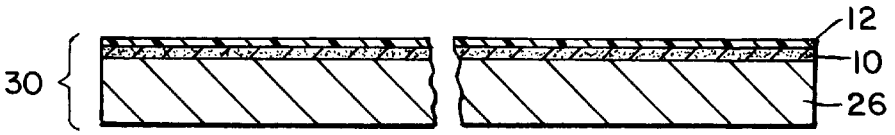
FIG. 3 is a side view of a molded sole assembly.

Referring to FIG. 2, an injection mold is shown generally at 16 and comprises a cavity 18, upper and lower mold halves 20 and 22 joined at a parting line 24. The surface of the upper mold is contoured at 27 to provide a pattern or design to what becomes the bottom of the sole. An injection port is shown at 28. The release liner 12 carrying the adhesive film 10 is placed onto the bottom portion of the mold, with the adhesive film side facing upwardly toward the cavity. The mold is closed and a sole is injection molded against the adhesive film 10. After the sole 26 has been formed it is removed from the cavity as shown in FIG. 2, forming an assembly 30 comprising an outer sole 26, a film of heat activatable adhesive 10 and the release film 12, see also FIG. 3. During the molding step, a portion of the adhesive migrates into the sole being formed. After the sole is formed the adhesive film is integral with the sole. This serves two functions. The adhesive film is bound to the sole and will not displace during handling and a strong bond is formed with the sole.

Figure 4:
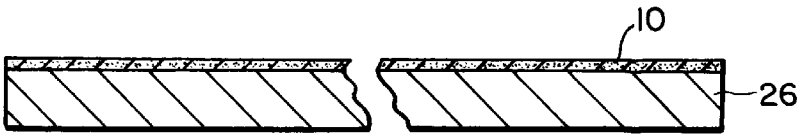
FIG. 4 is a side view of the molded sole assembly of FIG. 3 with the release liner removed.

When the sole is to be used in the sole-attaching operation the release liner 12 is removed, see FIG. 4, and the bonding step is effected. The adhesive surface is heat-activated by cal-rod rotary or quartz flash activator to a surface temperature of 115°–125° F.

Preferably the adhesive film is a urethane based adhesive and particularly a urethane adhesive having a polycaprolactone backbond. An exemplary adhesive would be UPACO 2448, Upaco Adhesives, Inc. a division of Worthen Industries, Inc. This adhesive is a thermoplastic polyurethane cast from solvent. This adhesive is especially suitable for bonding blown polyester polyurethane or TPR (Kraton) soles.

A sole material is selected from the prior art sole materials of urethane, polyvinyl chloride, Kraton, ethylene vinyl acetate, etc.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A method for forming a molded sole said sole intended to be attached to an upper which comprises:

placing a release film in a mold, the release film having heat activatable adhesive on one side thereof, the other side being free of adhesive;

forming in said mold a sole, the adhesive adhering to one side of the sole; and removing from the mold a laminated sole assembly consisting of a release film, a heat activatable adhesive and a sole wherein the heat activatable adhesive forms an integral part of the sole.

2. The method of claim 1 which comprises:

migrating at least a portion of the adhesive into the sole whereby the adhesive is both absorbed in the sole and adsorbed on the surface on the sole.

3. A method for attaching a molded sole to an upper which comprises:

placing a release film in a mold, the release film having heat activatable adhesive on one side thereof, the other side being free of adhesive;

forming in said mold a sole, the adhesive adhering to one side of the sole;

migrating at least a portion of the adhesive into the sole whereby the adhesive is both absorbed in the sole and adsorbed on the surface of the sole;

removing from the mold a laminated sole assembly consisting of a release film, a heat activatable adhesive and a sole wherein the heat activatable adhesive forms an integral part of the sole;

removing the release liner; and attaching an upper to the sole by heat activating the adhesive.

* * * * *